United States Patent [19]

Griffin, Jr.

[11] 4,129,752

[45] Dec. 12, 1978

[54] SHOCK RESISTANT LOUDSPEAKER ENCLOSURE

[75] Inventor: Timothy L. Griffin, Jr., Shutesbury, Mass.

[73] Assignee: Amanita Sound, Inc., Easthampton, Mass.

[21] Appl. No.: 843,836

[22] Filed: Oct. 20, 1977

[51] Int. Cl.[2] ..... H04R 1/02

[52] U.S. Cl. ..... 179/146 E; 181/148

[58] Field of Search ..... 181/148; 179/1 E, 146 R, 179/179, 180, 184, 146 E; 340/8 S; 248/358 R

[56] References Cited

U.S. PATENT DOCUMENTS

| | | | |
|---|---|---|---|
| 2,689,464 | 9/1954 | Wurtz | 248/358 R |
| 2,745,508 | 5/1956 | Vadersen | 179/179 |
| 2,812,382 | 11/1957 | Michael | 179/1 E |
| 3,053,980 | 9/1962 | Schmidt | 248/358 R |
| 3,342,498 | 9/1967 | Eberhardt | 181/148 |
| 3,473,625 | 10/1969 | Heisrath | 179/1 E |
| 3,778,562 | 12/1973 | Wright | 181/148 |
| 3,804,195 | 4/1974 | Everitt et al. | 181/148 |
| 3,947,646 | 3/1976 | Saito | 179/146 R |

FOREIGN PATENT DOCUMENTS

| | | | |
|---|---|---|---|
| 865289 | 5/1941 | France | 248/358 R |
| 369154 | 3/1939 | Italy | 248/358 R |
| 559839 | 9/1932 | Fed. Rep. of Germany | 179/180 |
| 1257853 | 1/1968 | Fed. Rep. of Germany | 179/1 E |
| 368654 | 3/1932 | United Kingdom | 179/146 R |
| 697135 | 9/1953 | United Kingdom | 179/146 R |

*Primary Examiner*—George G. Stellar

*Attorney, Agent, or Firm*—Chapin, Neal & Dempsey

[57] ABSTRACT

A shock resistant loudspeaker enclosure includes a resilient shell formed with an opening therein and a resilient, shock resistant bracket secured to the shell about the periphery of the opening. A loudspeaker mounting board or baffle is secured to the shock resistant bracket through a rigid frame thereby closing the shell opening.

7 Claims, 3 Drawing Figures

Fig. 1.
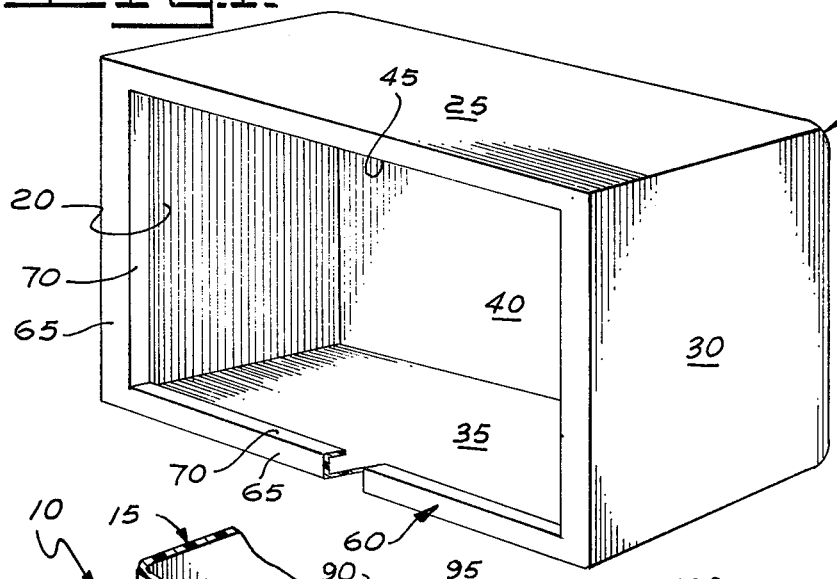
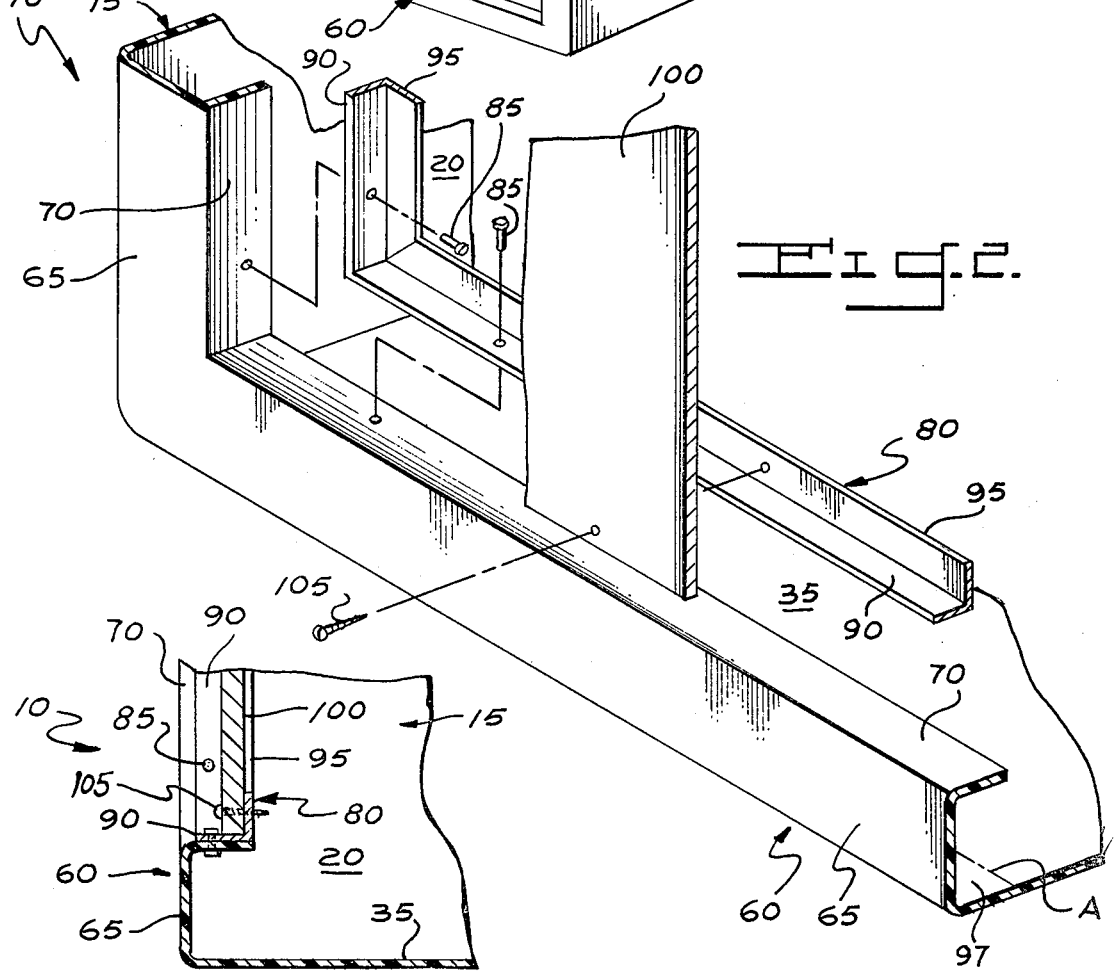
Fig. 2.
Fig. 3.

SHOCK RESISTANT LOUDSPEAKER ENCLOSURE

BACKGROUND

This invention relates to apparatus for the shock resistant mounting of loudspeakers within enclosures therefor.

Loudspeaker enclosures particularly those employed by entertainers for voice and musical instrument amplification are subject to vibration and severe jarring due to use and handling in the normal course of set-up, take-down and transport. Such physical abuses often result in damage to the loudspeakers and other electronic components mounted within the enclosures, necessitating expensive repairs and costly replacements.

Typically, the loudspeakers and other electronic components such as cross over circuitry and the like are mounted to a speaker board or baffle which is rigidly secured to a stiff enclosure shell over an opening therein. Therefore, it will be appreciated that shocks from impacts in dropping or other mishandling and vibration encountered during use and in transit are transmitted through the enclosure and speaker board to the loudspeakers and other electronic components secured thereto.

In an effort to enable the loudspeakers themselves to withstand such vibration and shock, capacitors which apply a continuous static charge thereto have been employed in prior art enclosures as have reinforced loudspeaker frames. Although such improvements may aid in enabling the loudspeakers to withstand such shock and vibration, they provide no suitable means to isolate the loudspeakers and other electronic components from the transmission of such shock and vibration thereto from the enclosure shell through the loudspeaker board. In further efforts to provide shock resistant loudspeaker enclosures, double-walled enclosure shells filled with a polymeric foam have been employed, the speaker boards being fixed to the inner shell wall. Such shell construction may render the enclosure overly bulky and uneconomical to produce and may fail to isolate the loudspeakers and other electrical components mounted therewithin from shock and vibration applied to the shell or loudspeaker board.

Accordingly, it is an object of the present invention to provide a shock resistant loudspeaker enclosure which overcomes the deficiencies of the prior art.

It is another object of the present invention to provide a shock resistant loudspeaker enclosure in which the loudspeakers and other electrical apparatus mounted therein are effectively isolated from any shock and vibration.

It is another object of the present invention to provide a shock resistant loudspeaker enclosure of minimal bulk and characterized by an ease and economy of manufacture.

DESCRIPTION OF THE DRAWINGS

These and other objects will become more readily apparent from the following detailed description taken in connection with the accompanying drawings in which:

FIG. 1 is a three dimensional view of a shell employed in the shock resistant loudspeaker enclosure of the present invention, a portion of the shell being broken away to show details of construction;

FIG. 2 is an exploded three dimensional view of a front corner of the loudspeaker enclosure of the present invention, it being understood that the remaining portions of the enclosure are of identical construction; and FIG. 3 is a fragmentary, sectional view of a front portion of the loudspeaker enclosure.

DESCRIPTION OF THE PREFERRED EMBODIMENT

Referring to the drawings, the shock resistant loudspeaker enclosure of the present invention is shown generally at 10 and comprises a resilient shell or case 15 having a sidewall structure 20, 25, 30 and 35 and a back wall 40 (see FIG. 1). Shell 15 includes an opening 45 in the front thereof for the mounting of loudspeakers and other collateral electronic devices such as crossover networks and the like therewithin. While shell 15 is shown as being generally rectangular in shape, it will be understood that an enclosure embodying the present invention may be of any suitable size and shape as dictated by the physical size and arrangement of the loudspeakers (not shown) to be mounted therein.

As set forth hereinabove, loudspeaker enclosures, particularly those employed in the entertainment industry are subject to physical shock, jarring and vibration in the normal course of operation and transport. To minimize the risk of damage to the loudspeakers and collateral electronic components, the loudspeaker enclosure of the present invention is provided with a novel means for isolating the loudspeakers and other components from such shock, jarring and vibration.

These novel means comprise a resilient bracket 60 integral with shell 15 about the periphery of opening 45. Bracket 60 includes shoulder 65 extending inwardly from the sidewalls and a perpendicular mounting flange 70 extending rearwardly from the inner edge of shoulder 65. In the preferred embodiment, shoulder 65 and flange 70 are integrally molded with shell 15 from a low density polyethylene. However, it will be appreciated that the shell and bracket may be integrally formed from any material of resilience sufficient to isolate the baffle and loudspeakers mounted thereon from shock and vibration.

Referring to FIGS. 2 and 3, a frame 80 longitudinally coextensive with flange 70 is secured thereto in contiguous relation therewith as by rivets 85. Frame 80 provides a means by which the loudspeaker mounting baffle is secured to flexible bracket 60. The frame comprises a pair of mutually perpendicular, longitudinally coextensive lips 90 and 95. Lip 90 is secured to flange 70 in the manner described hereinabove, while lip 95 provides a flat mounting surface for the loudspeaker baffle. In the preferred embodiment, frame 80 is formed from a relatively stiff, lightweight material such as aluminum, but it will be appreciated that other materials such as synthetic plastics may be employed.

A loudspeaker mounting baffle or board 100 to which the loudspeakers and other collateral electronic components (not shown) are mounted is fixed to frame 80 at lip 95 by any suitable means such as screws, one of which is shown at 105. Baffle 100 is formed from any relatively rigid material such as a wood laminate possessing the required acoustic properties and covers opening 45, thereby completing the enclosure construction.

It will be appreciated that the resiliency and cantilever construction of bracket 60 effectively isolates the loudspeakers and other electronic devices fixed to baffle 100 from jarring, shock and vibration, thereby minimizing the risk of damage to these components and the costly replacement or repair thereof. Any forces from such physical abuses applied to the shell will be substantially absorbed by bracket 65 before being transmitted to the baffle. Likewise, such forces applied directly to the baffle will be absorbed in large measure by a temporary distortion of the resilient bracket without being transmitted directly through the baffle to the loudspeakers.

What is claimed is:

1. A shock resistant loudspeaker enclosure comprising:

a resilient shell including a sidewall structure having an open front and further including a back wall, a resilient bracket integral with said shell and disposed relative thereto about the periphery of said open front said bracket comprising a shoulder extending inwardly from said sidewall structure and a mounting flange extending perpendicular to said shoulder from an inner edge thereof, a rigid frame secured to said bracket and a loudspeaker mounting baffle secured to said rigid frame and enclosing said opening.

2. The loudspeaker enclosure of claim 1 wherein said flange is integral and longitudinally coextensive with said shoulder.

3. The loudspeaker enclosure of claim 1 wherein said flange extends rearwardly from said inner shoulder edge.

4. The loudspeaker enclosure of claim 1 wherein said frame comprises first and second mutually perpendicular lips, said first lip being disposed parallel to said flange and secured thereto in contiguous relation therewith and said second lip providing a mounting surface for said loudspeaker mounting baffle.

5. The loudspeaker enclosure of claim 4 wherein said first and second frame lips are longitudinally coextensive.

6. The loudspeaker enclosure of claim 1 wherein said shell and said bracket are formed from a low density polyethylene.

7. The loudspeaker enclosure of claim 1 wherein said frame is formed from aluminum.

* * * * *